US007156319B2

(12) United States Patent
Kowalski

(10) Patent No.: US 7,156,319 B2
(45) Date of Patent: Jan. 2, 2007

(54) CONCRETE RAILROAD TIE WITH GUIDE PLATES FOR THE RAIL BASE

(75) Inventor: Martin Kowalski, Nuremberg (DE)

(73) Assignee: Pfleiderer Infrastruktechnik GmbH & Co. KG, Neumarkt (DE)

( * ) Notice: Subject to any disclaimer, the term of this patent is extended or adjusted under 35 U.S.C. 154(b) by 136 days.

(21) Appl. No.: 10/621,765

(22) Filed: Jul. 17, 2003

(65) Prior Publication Data

US 2004/0232254 A1 Nov. 25, 2004

(30) Foreign Application Priority Data

Jul. 25, 2002 (DE) ..... 102 33 784

(51) Int. Cl.
*E01B 9/00* (2006.01)

(52) U.S. Cl. ..... 238/265; 238/287; 238/297; 238/298; 238/299

(58) Field of Classification Search ..... 238/2, 238/5, 9, 27, 29, 83, 264, 265, 310, 315, 238/38, 35, 37, 30, 115, 68, 287, 297, 298, 238/299

See application file for complete search history.

(56) References Cited

U.S. PATENT DOCUMENTS 3,904,112 A * 9/1975 Thim et al. ..... 238/84
4,078,724 A * 3/1978 McCormick et al. ..... 238/351
4,907,740 A * 3/1990 Oberweiler et al. ..... 238/283
6,364,214 B1 * 4/2002 Sonneville et al. ..... 238/115
6,488,215 B1 * 12/2002 Mohr ..... 238/2
6,659,363 B1 * 12/2003 Mohr ..... 238/115

FOREIGN PATENT DOCUMENTS

| | | |
|---|---|---|
| DE | 38 20 243 | 6/1988 |
| DE | 297 07 425 | 4/1997 |
| DE | 100 30 998 | 6/2000 |
| DE | 198 48 928 | 10/2000 |
| EP | 0 767 274 | 4/1997 |

* cited by examiner

*Primary Examiner*—Mark T. Le
(74) *Attorney, Agent, or Firm*—Jordan and Hamburg LLP

(57) ABSTRACT

A concrete railroad tie, especially a two-block railroad tie, with an elastic rail support for ballast and solid tracks, with guide plates with twisting-prevention devices disposed in the supporting region between the base of the rail and the lateral, raised shoulders of the railroad tie, characterized in that the support area is constructed essentially flat without continuous, deep depressions.

10 Claims, 6 Drawing Sheets

F1

CONCRETE RAILROAD TIE WITH GUIDE PLATES FOR THE RAIL BASE

BACKGROUND OF THE INVENTION

Figure 1:
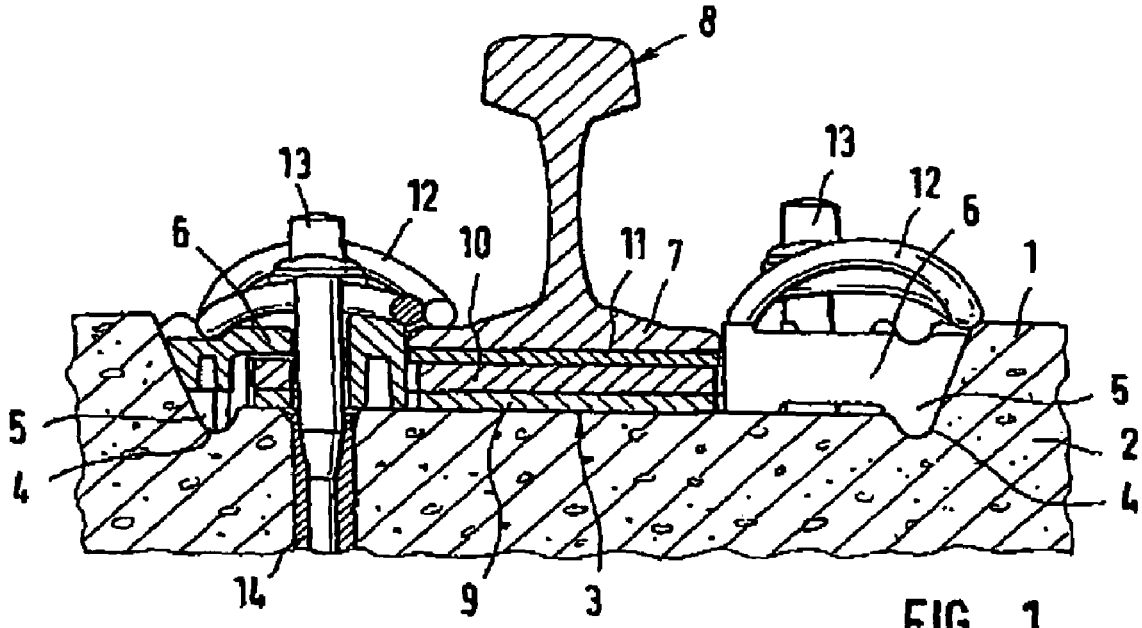
FIG. 1 PRIOR ART

The invention relates to a concrete railroad tie, especially to a two-block railroad tie, with an elastic rail support for ballast and solid tracks, with guide plates with twisting-prevention devices disposed in the supporting region between the base of the rail and the lateral, raised shoulders of the railroad tie.

For all conventional, concrete railroad ties, whether monoblock railroad ties or two-block railroad ties for ballast and solid tracks, continuous, relatively deep depressions are produced in the concrete next to the raised shoulders of the railroad tie for accommodating a correspondingly protruding rib of the guide rails, which are constructed as angle guiding plates.

It is one of the disadvantages of this construction that, when producing the concrete railroad ties in the casting molds, inserts with high ribs must be introduced in order to form the depressions. These inserts can only be produced from very high plates, which must be milled out correspondingly deep. This means that the loss of the very expensive material of these inserts is very appreciable and that the processing costs are very high, because the depressions have different radii of curvature on the inside and outside.

SUMMARY OF THE INVENTION

It is therefore an object of the invention to configure a concrete railroad tie of the type named above, so that simpler guiding plates, occupying less space, can be used and that mold inserts, which are provided with high lugs and particularly complicated to manufacture, are avoided.

Pursuant to the invention, this objective is accomplished owing to the fact that support region is constructed essentially flat without continuous deep depressions. Advantageously, the essentially flat support region is provided with lugs to prevent twisting.

Due to the omission of the depressions, which previously were basically provided, inserts, which are intended for the casting molds for producing the concrete railroad ties and are expensive to manufacture, are omitted. Furthermore, there is the possibility of using simpler guide plates without the high ribs, which prevent twisting.

The invention, moreover, is based on the realization that, in view of the contact between the guide plates and the raised shoulders, these ribs, which prevent twisting, can develop the additional, twisting preventing effect only to a limited extent. Moreover, it is possible to achieve this effect in a similar manner with considerable less expense by protruding lugs, which prevent twisting.

Aside from the possibility of providing the support region with centrally disposed elevations, which limit the guide plates on the inside, provisions can also be made, in a development of the invention, that the support region, in the area of each guide plate, preferably has two lateral lugs to prevent twisting, which engage corresponding recesses in the guide plate.

In this connection, these lugs, which prevent twisting, may be cemented to the railroad tie or formed by dowels, especially by plastic dowels, which are pressed into prefabricated recesses into the concrete.

Finally, is also within the scope of the invention to provide, instead of lugs that prevent twisting, small depressions, which prevent twisting, in the region of the lateral edges of the support area and which are engaged by appropriate lugs of the of the plate that prevents twisting.

Further advantages, distinguishing features and details of the invention arise out of the following description of some examples as well as from the accompanying drawings.

IN THE DRAWINGS

Figure 2:
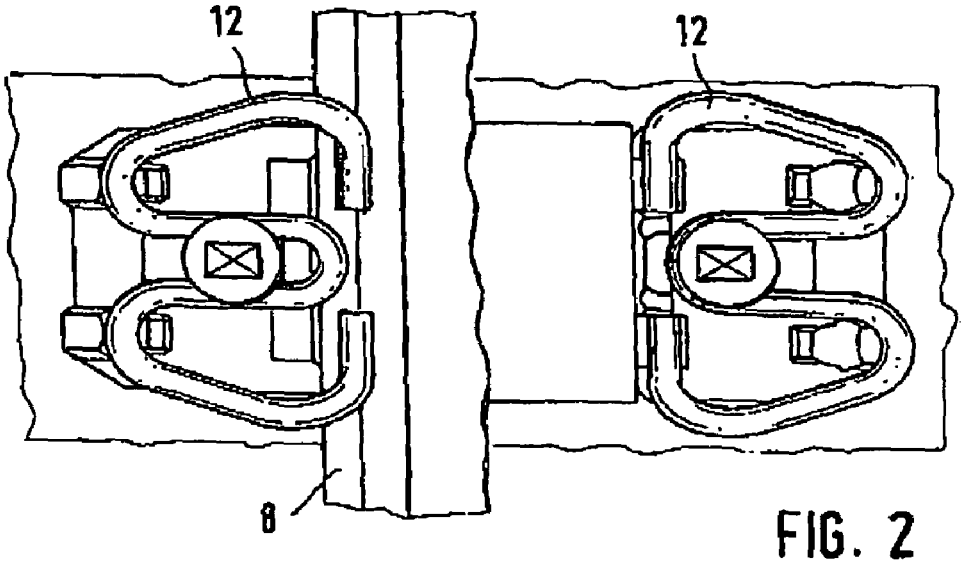
FIG. 2 PRIOR ART
Figure 3:
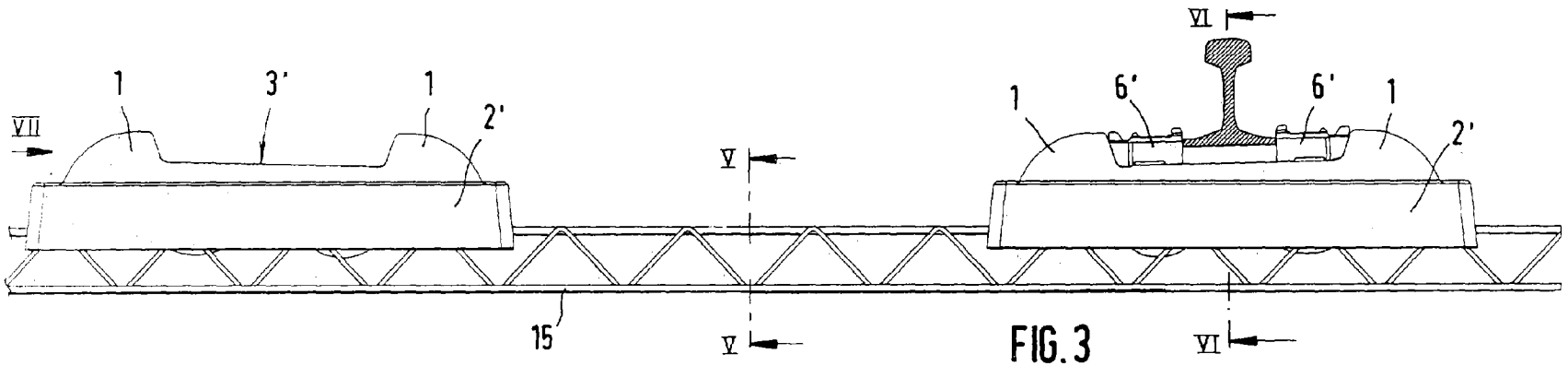
Figure 4:
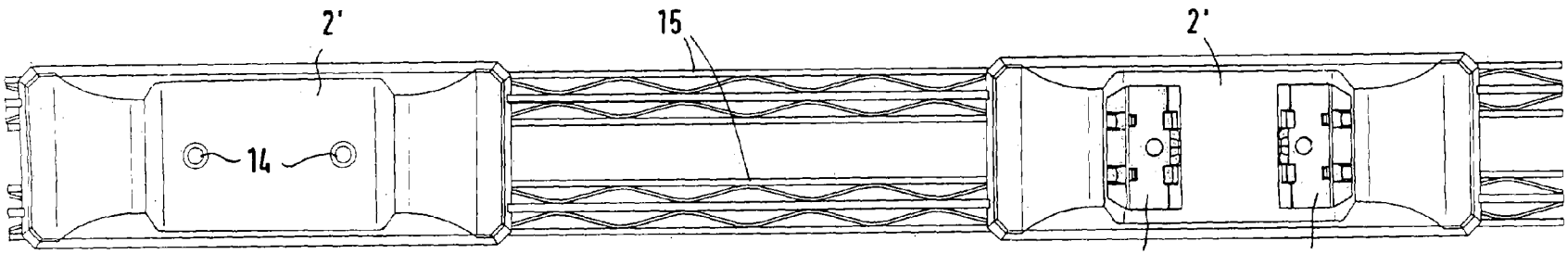
Figure 7:
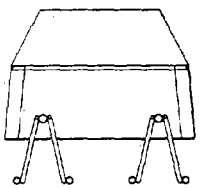
Figure 6:
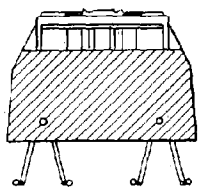
Figure 5:
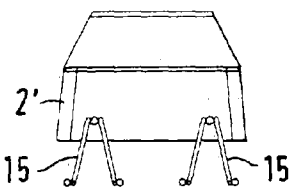
Figure 8:
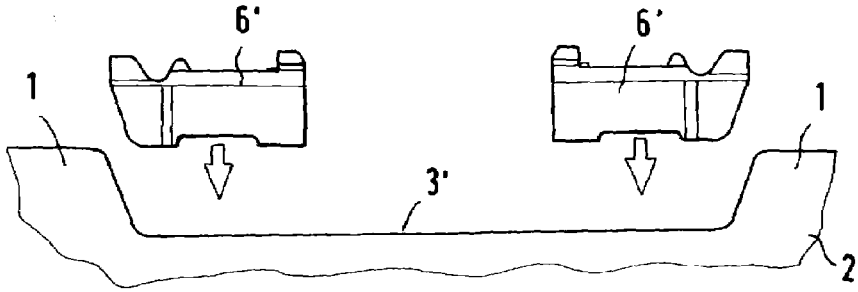
Figure 9:
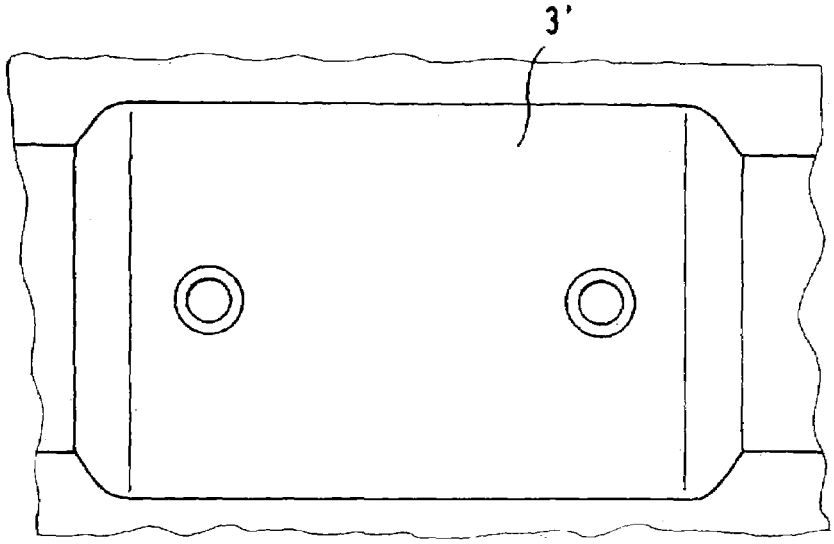

FIG. 1 shows a partial section through a conventional, highly elastic rail fastening for solid tracks, FIG. 2 shows a plan view of the rail fastening of FIG. 1, FIG. 3 shows an inventive two-block railroad tie for constructing a Rheda 2000, solid track system, FIG. 4 shows a plane view of railroad tie of FIG. 3, FIGS. 5 to 7 show sections along the lines V—V, VI—VI or a view along the arrow VII of the railroad tie of FIGS. 3 and 4, FIG. 8 shows an enlarged projection of the rail support area of a single-block of the railroad tie of FIGS. 3 and 4 without additional lugs for preventing twisting, FIG. 9 shows a plan view of the rail support area of FIG. 8, and FIGS. 10 to 21 show projections and associated plan views of modified rail support areas with differently constructed lugs to prevent twisting.

DESCRIPTION OF THE PREFERRED EMBODIMENT

FIGS. 1 and 2 show a conventional highly elastic rail fastening for solid tracks with a rail support area 3, which is disposed between two raised shoulders 1 of the concrete 2 of the railroad tie and has, aside from a flat middle section, two deep depressions 4, which traverse the railroad tie transversely and accommodate rib-shaped bends 5 of the angle guiding plates 6. These angle-guiding plates 6 are in lateral contact with the base 7 of the rail 8 and are supported at on the other side at the shoulders 1 of the concrete. For the highly elastic mounting of the rail 8, initially an intermediate plate 9 and, on the latter, a base plate 10 are disposed on the rail support area 3. Finally, a further 2 to 12 mm thick intermediate layer 11 is disposed on the intermediate plate 9 underneath the rail base 7. The conventional W-shaped anchor clamps, which can be fastened with the help of railroad tie bolts 13, which in turn engage screw-in dowels 14 in the concrete 2 of the railroad tie, are labeled 12.

The preinstalled position of the rail fastening parts is shown in FIG. 2 and the installed position in FIG. 3.

FIG. 3 to 7 show a two-block railroad tie, the individual blocks 2", which are connected with one another in the example shown by reinforcement constructed as lattice beams 15, being provided with rail support areas 3", which are constructed essentially flat without the continuous depressions 4 shown in FIGS. 1 and 2. As a result, there is no need to use inserts with high ribs, which are complicated to manufacture, for the casting molds for producing the railroad ties. On the other hand, the guiding plates 6" also no longer require the ribs 5, which are present in FIGS. 1 and 2.

Figure 10:
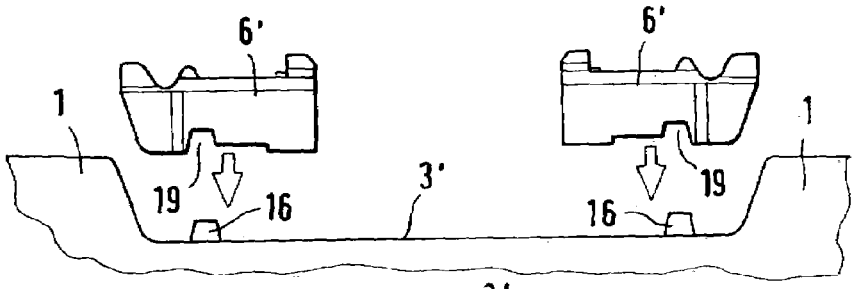
Figure 11:
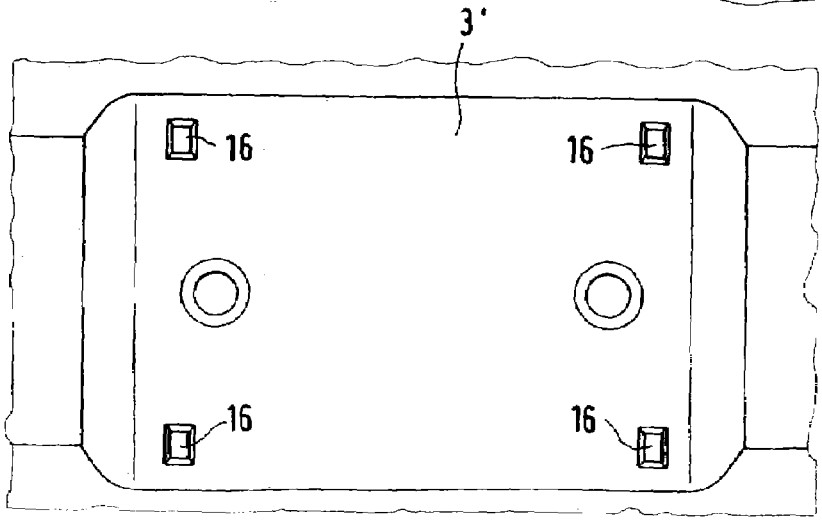
Figure 12:
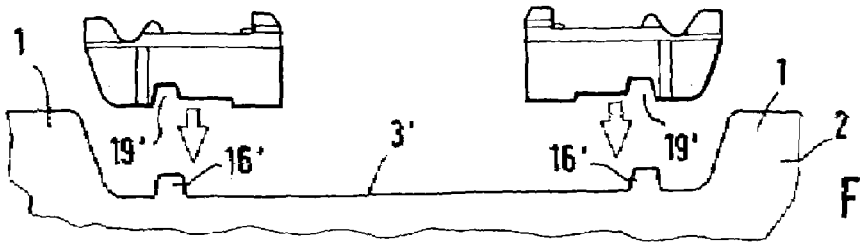
Figure 13:
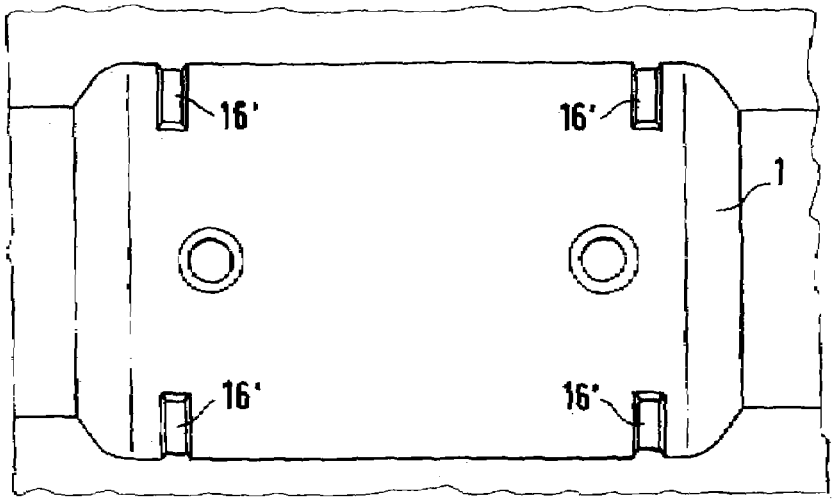

For most embodiments, the raised shoulders 1 adequately prevent twisting of the set-down guide plates. In order to prevent it even better, especially in the pre-installed state, in much the same way as in the case of conventional plates with ribs, which engage deep depressions in the concrete railroad tie, two lateral lugs 16, which prevent twisting, may be disposed on the flat support region 3" in the area of each guide plate. The lateral lugs 16 are configured either as shown in FIGS. 10 and 11 or as shown in FIGS. 12 and 13, in which they are constructed and disposed only somewhat differently geometrically and cemented, for example, on the support areas 3".

Figure 14:
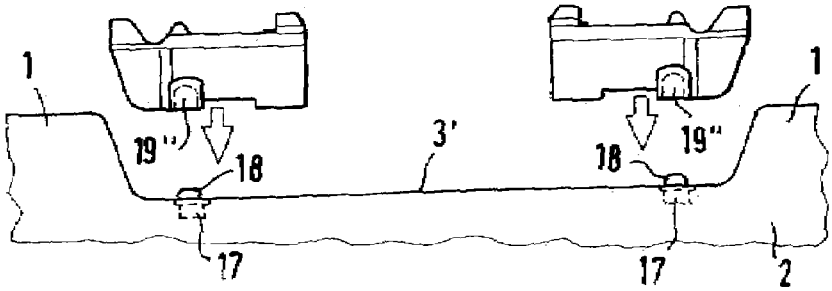
Figure 15:
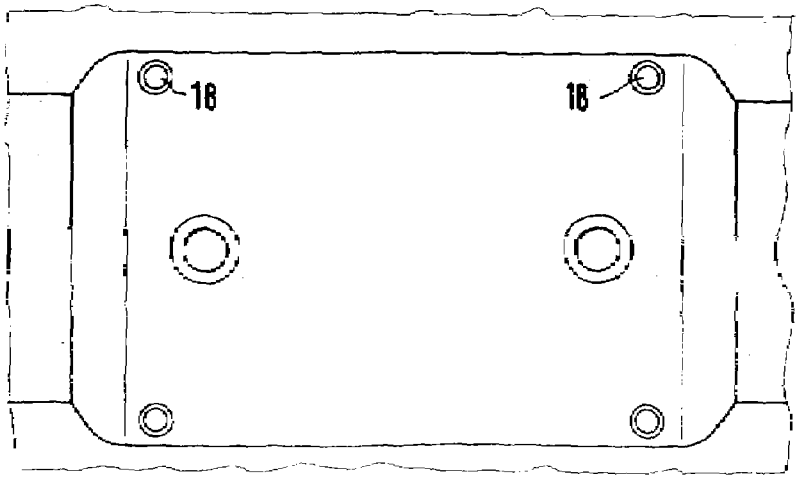

FIGS. 14 and 15 show a variation in which the lugs 16, which prevent twisting and are cemented on, are replaced by plastic dowels 18, which are pressed into pre-fabricated recesses 17 of the concrete 2 or cemented in during the manufacture and engage appropriate recesses 19 of the guide plates, so as to prevent twisting.

Figure 16:
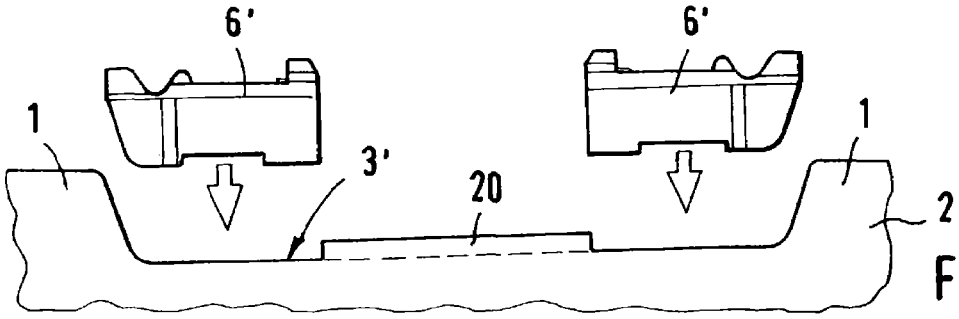
Figure 17:
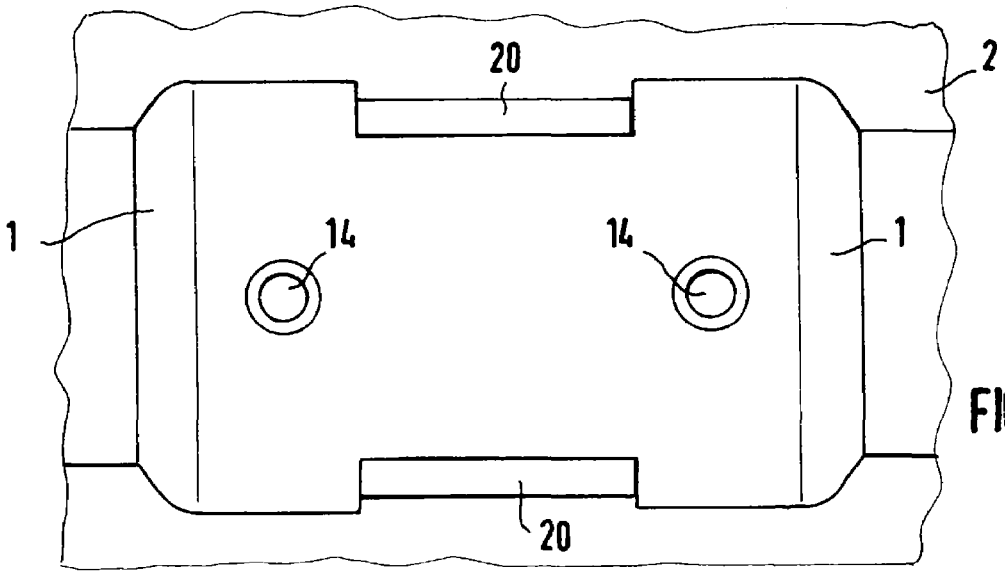

Finally, FIGS. 16 and 17 show an embodiment, in which centrally disposed web-like elevations 20 are integrally molded in the support area 3" for the rails and form a boundary on the inside for the guide plates. In combination with the shoulders 1, these elevations 20 ensure excellent protection against twisting for the guide plates 6".

Figure 18:
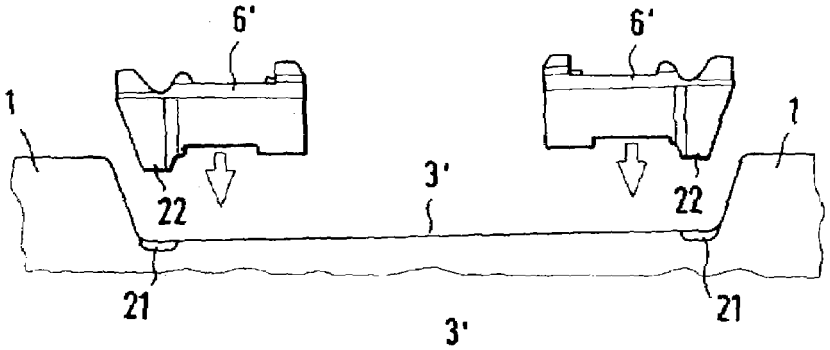
Figure 19:
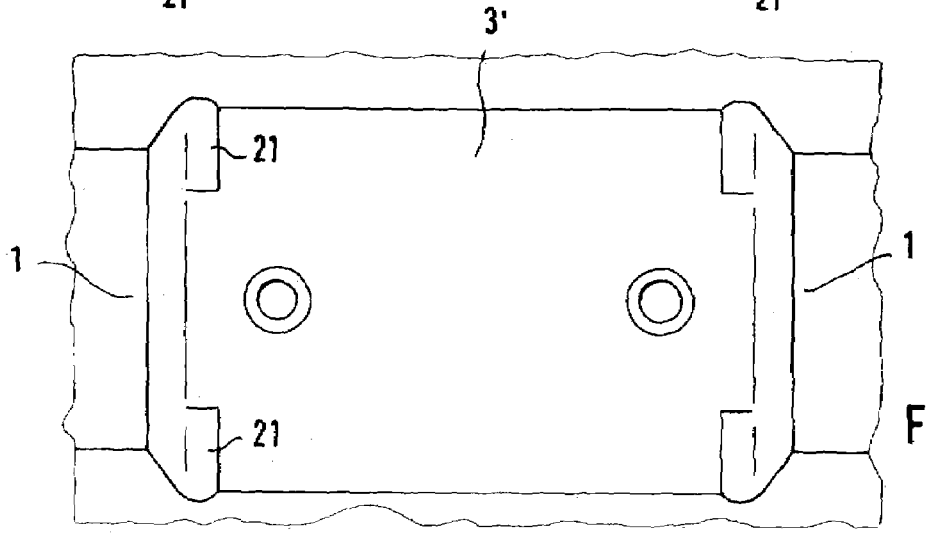

In FIGS. 18 and 19, a variation is shown, in which the rail support 3 is provided in the region of the raised curvature to the shoulders 1 with short, relatively low depressions 21, which are disposed in the region of the outer edges of the rail support 3" and which are engaged by appropriately shaped lugs 22, which protrude over the lower support surface of the guide plate 6".

Figure 20:
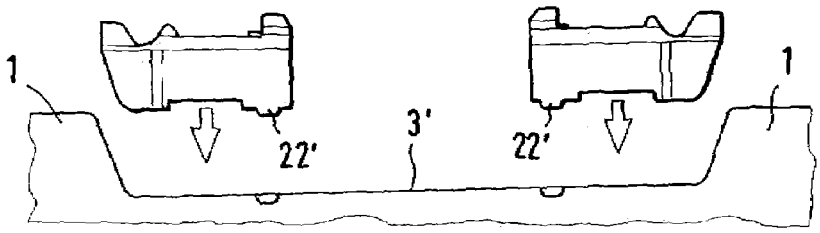
Figure 21:
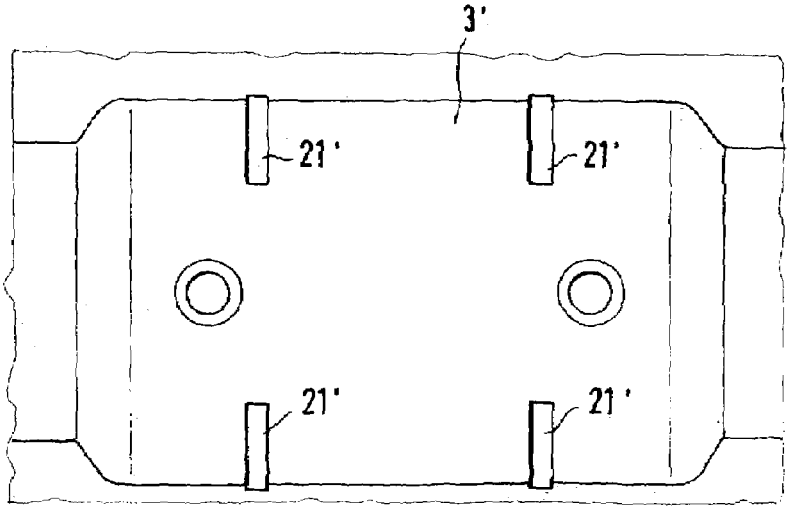

The example of FIGS. 20 and 21 differs from that of FIGS. 18 and 19 owing to the fact that the lugs 22" are disposed not at the outside of the guide plates 6", but in the region of their inner side, facing the rail base, and the depressions 21" correspondingly are also offset further from the shoulders towards the inside.

I claim:

1. A concrete railroad tie comprising:

an elastic rail support;

lateral, raised shoulders and a support region disposed between a base of a rail and said raised shoulders, the rail being longitudinally received in a crosswise direction of said elastic rail support;

guide plates including twisting-prevention devices disposed in said supporting region;

a support area for supporting said guide plates, said support area being essentially flat without continuous, deep depressions beneath said guide plates;

said support area includes outer edges, each of said outer edges comprising depressions spaced apart in said crosswise direction for preventing twisting; and said twisting-preventing devices of said guide plates comprising spaced lugs, said spaced lugs engaging respective ones of said depressions.

2. The concrete railroad tie of claim 1, characterized in that the support area (3") is provided with centrally disposed elevations (20), which, on the inside, form the boundary of the guide plates (6").

3. The concrete railroad tie of claim 1, characterized in that the support area (3"), in the region of each guide plate (6"), preferably has two lateral lugs (16, 16", 18), which engage appropriate recesses in the guide plates (19, 19", 19"").

4. The concrete railroad tie of one of the claims 1 and 2–3, characterized in that the lugs (16, 16"), which prevent twisting, are cemented on.

5. The concrete railroad tie of claim 3, characterized in that the lugs (18), which prevent twisting, are formed by dowels, especially by plastic dowels (18), which are pressed into pre-fabricated recesses (17) of the concrete (2) or cemented in during the fabrication.

6. The concrete railroad tie of claim 1 wherein said tie is a two block railroad tie.

7. A concrete railroad tie comprising:

an elastic rail support, said rail support including a supporting region for supporting a rail foot in a crosswise direction of said elastic rail support, said supporting region being essentially flat, said rail support further including lateral, raised shoulders;

guiding plates disposed on said rail support in said crosswise direction of said elastic rail support and located adjacent to said shoulders;

twisting-preventing devices disposed on both of said rail support and said guiding plates between said supporting region and said shoulders;

said twisting-preventing devices on one of said supporting region and said guiding plates including depressions spaced apart in said crosswise direction and an other one of said twisting-preventing devices on a remaining one of said supporting region and said guiding plates including lugs, said depressions correspondingly positioned for engaging respective ones of said lugs for preventing twisting.

8. A concrete railroad tie comprising:

a rail support including a pair of raised shoulders and a support region disposed between said pair of raised shoulders on which a rail foot is supportably receivable positioned in a crosswise direction of said rail support;

guiding plates receivable to the rail support in said crosswise direction and positionable within said support region for lateral support against said pair of shoulders;

a one of said supporting region and said guiding plates including depressions spaced apart in said crosswise direction, and a remaining one of said supporting region and said guiding plates including lugs, said lugs being correspondingly positioned with respect to said depressions such that said depressions and said lugs respectively engage one another, thereby acting to inhibit twisting of the guiding plates when received to said supporting region.

9. The concrete railroad tie of claim 8 wherein said tie is a two block railroad tie.

10. The concrete railroad tie of claim 8 wherein said depressions are provided in said supporting region in a region adjacent to said raised shoulders and proximate to opposed side boundaries of the rail support in the crosswise direction, said lugs being carried on a lower support surface of said guiding plates.

* * * * *